US006881161B2

(12) United States Patent
Heflin, Sr.

(10) Patent No.: US 6,881,161 B2
(45) Date of Patent: Apr. 19, 2005

(54) BASKETBALL TRAINING APPARATUS

(76) Inventor: Ronald L. Heflin, Sr., 4022 W. 79th Ct., #31, Merrillville, IN (US) 46410

( * ) Notice: Subject to any disclaimer, the term of this patent is extended or adjusted under 35 U.S.C. 154(b) by 0 days.

(21) Appl. No.: 10/604,137

(22) Filed: Jun. 27, 2003

(65) Prior Publication Data

US 2004/0002397 A1 Jan. 1, 2004

Related U.S. Application Data

(60) Provisional application No. 60/319,372, filed on Jul. 1, 2002.

(51) Int. Cl.[7] ..... A63B 69/00; G09B 19/00

(52) U.S. Cl. ..... 473/448; 473/447; 434/248

(58) Field of Search ..... 473/422, 433, 473/447–449, 452, 472, 479–489; 273/317.3, 397, 402, 407; 434/248

(56) References Cited

U.S. PATENT DOCUMENTS

| | | | | |
|---|---|---|---|---|
| 3,137,503 | A | 6/1964 | Ballard | |
| 3,700,240 | A | * 10/1972 | San Emeterio | 273/407 |
| 3,941,382 | A | 3/1976 | Clark | |
| 4,206,915 | A | 6/1980 | Woodcock | |
| 4,226,416 | A | * 10/1980 | Callanan | 473/448 |
| 5,120,053 | A | 6/1992 | Head et al. | |
| 5,354,048 | A | * 10/1994 | Winesberry, Jr. | 473/447 |
| 5,390,912 | A | * 2/1995 | Silagy | 473/448 |
| 5,549,293 | A | 8/1996 | Seifert | |
| 5,665,016 | A | * 9/1997 | Burnett | 473/448 |
| 5,720,485 | A | 2/1998 | Oswald | |
| 5,800,290 | A | 9/1998 | Barry | |
| 5,807,195 | A | 9/1998 | Westbrook | |
| 5,906,554 | A | 5/1999 | Oswald | |
| 5,928,094 | A | 7/1999 | Sagedahl | |
| 6,190,270 | B1 | 2/2001 | Barry | |
| 2001/0005701 | A1 | 6/2001 | Barry | |
| 2001/0034278 | A1 | 10/2001 | Villacorta | |

* cited by examiner

*Primary Examiner*—Mitra Aryanpour
(74) *Attorney, Agent, or Firm*—Gary M. Hartman; Domenica N. S. Hartman; Hartman & Hartman

(57) ABSTRACT

A basketball training apparatus for improving shooting skills and accuracy on all playing levels. The basketball training apparatus is adapted for use with a basketball rim placed above a playing surface, and comprises a base on the playing surface beneath the basketball rim, a plurality of arms extending in radial directions from the base, a plurality of shooting markers spaced apart along the length of each arm, and vision markers attached to the basketball rim. Each vision marker is radially aligned with a corresponding one of the arms. With this arrangement, a user, when standing on one of the shooting markers and facing the basketball rim, is provided with visual shooting assistance as a result of the arm being radially aligned with one of the vision markers located on a region of the basketball rim that is nearest the user.

20 Claims, 1 Drawing Sheet

BASKETBALL TRAINING APPARATUS

CROSS REFERENCE TO RELATED APPLICATIONS

This application claims the benefit of U.S. Provisional Application No. 60/319,372, filed Jul. 1, 2002.

BACKGROUND OF INVENTION

1. Field of the Invention

The present invention generally relates to sports training equipment and techniques. More particularly, this invention relates to a basketball training apparatus configured to assist the user in improving his or her shooting skills and accuracy on all playing levels.

2. Description of the Related Art

Various basketball training equipment has been proposed, examples of which include U.S. Pat. No. 3,941,382 to Clark and U.S. Pat. No. 5,928,094 to Sagedahl. Clark discloses a game that makes use of a number of marking elements held together in a single row with straps. With the straps, the marking elements are aligned to extend radially out from beneath a basketball rim so that a scoring system is established based on a point value associated with each marking element. Sagedahl discloses a U-shaped clip that attaches to the rim of a basketball hoop. The clip is preferably a different color than the hoop and is intended to help align a shot made by a player.

SUMMARY OF INVENTION

The present invention provides a basketball training apparatus designed to improve shooting skills and accuracy on all playing levels, e.g., from elementary to professional. The basketball training apparatus is adapted for use with a basketball rim placed above a playing surface, and comprises a base on the playing surface beneath the basketball rim, a plurality of arms extending in radial directions from the base, a plurality of shooting markers spaced apart along the length of each arm, and at least one member attached to the basketball rim and comprising vision markers. Each vision marker is radially aligned with a corresponding one of the arms. With this arrangement, a user, when standing on one of the shooting markers and facing the basketball rim, is provided with visual shooting assistance as a result of the arm being radially aligned with one of the vision markers located on a region of basketball rim that is nearest the user, and therefore readily visible to the user.

Other objects and advantages of this invention will be better appreciated from the following detailed description.

DETAILED DESCRIPTION

Figure 1:
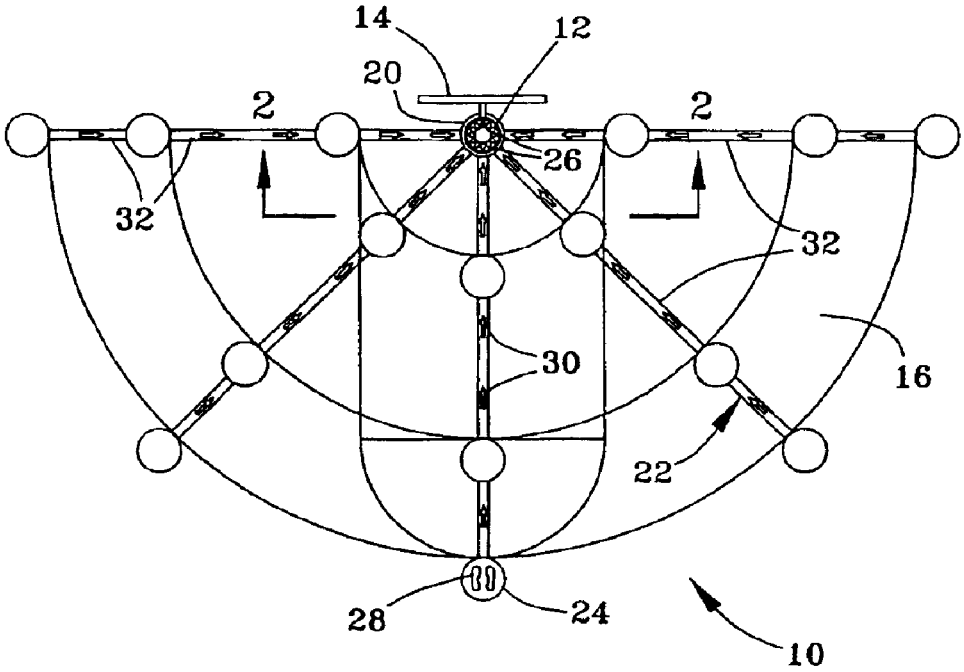
FIG. 1 shows a plan view of the basketball training apparatus in accordance with an embodiment of the invention.

A plan view of basketball training apparatus 10 in accordance with an embodiment of this invention is shown in FIG. 1. The apparatus 10 is adapted to be used in conjunction with a conventional basketball playing area, including a basketball rim 12 mounted to a backboard 14. The apparatus 10 comprises a base 20 placed directly beneath the basketball rim 12 on a suitable playing surface 16. In a preferred embodiment, the apparatus 10 further includes arms 22 (five in FIG. 1) extending radially from the base 20, shooting markers 24 located along the lengths of the arms 22 to identify locations from which a user shoots a basketball toward the rim 12, and vision markers 26 attached to the rim 12 and radially aligned with each of the arms 22. Each arm 22 is preferably formed of one or more individual straps 32. If an arm is formed of multiple straps 32, the straps 32 can be placed between shooting markers 24 and aligned to define the arm 22 as shown. The straps 32 are preferably of different lengths, e.g., six feet, fourteen feet and twenty feet, so that the arms 22 can be sized and the shooting markers 24 readily located for short, midrange and three-point shooting practice, respectively. Each shooting marker 24 preferably includes foot imprints 28 that assist in proper foot placement when shooting. Arrows 30 are preferably formed or placed on each of the arms 22, pointing toward the base 20.

At least some and preferably all of the components of the apparatus 10 have indicia that are color-coded to promote the shooter's vision, direction and accuracy. For example, each vision marker 26 is preferably the same color as the arm 22 with which it is aligned, and/or the same color as the shooting makers 24 (or the foot imprints 28 thereof) on the arm 22 with which it is aligned, and/or the same color as the arrows 30 on the arm 22 with which it is aligned. While color coding is preferred, it is foreseeable that some other visual indicia could be used to distinguish the vision markers 26 and associate the markers 26 with their respective arms 22 or arm components.

In use, the base 20 is placed directly beneath the basketball rim 12, and the arms 22 are arranged to extend radially outward from the base 20. The base 20 is preferably round and formed of a non-skid material, such as rubber matting. By constructing the arms 20 of individual straps 32, the lengths of the arms 22 be varied, e.g., distances from the base 20 corresponding to the free throw line, a corner shot, the three-point range, medium shot range, short shot range, etc. The arms 22 can be attached to the base 20 and the shooting markers 24 with VELCRO (hook-and-loop fastener) or any other releasable or permanent attachment means. The shooting markers 24 are preferably detachable to allow the user to focus on specific shooting areas. As with the base 20, the shooting markers 24 are preferably round and formed of a non-skid material, (e.g., rubber matting), and serve to give the shooter a spot-up position.

Figure 2:
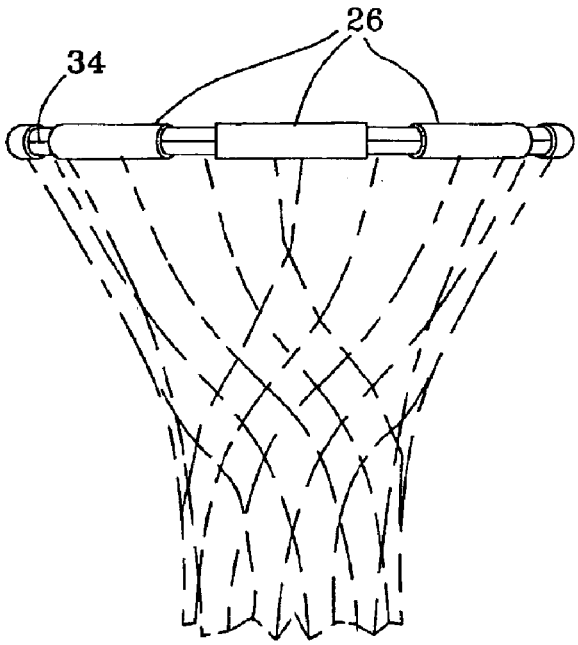
FIG. 2 shows a front edge view of a basketball rim equipped with visual markers in accordance with the invention.

The vision markers 26 are preferably in a form that can be releasabley attached to the rim 12. For example, the vision markers 26 may be in the form of separate plastic clips that individually mount to the rim 12 as shown in FIG. 1, or in the form of separate plastic clips that individually mount to a tube 34 as shown in FIG. 2. or in the form of colored sections of the tube 34 shown in FIG. 2. To provide for releasable attachment, the markers 26 (e.g., clips) or the tube 34 to which the markers 26 are mounted preferably have a C-shaped cross-section. Alternatively, the markers 26 could be in the form of VELCRO (hook-and-loop fastener) straps, which may be more durable and easily replaceable than a tube or individual plastic clips. Because the visio markers 26 are located on the rim 12 in positions corresponding to radials defined by the arms 22, and therefore on the near edge of the rim 12 nearest the shooter, each marker 26 provides a readily visible focal point to improve vision, shooting technique and accuracy. As such, the apparatus 10 enables a shooter to sopt up on a color-coded shooting marker 24 located on one of the arms 22, and then shoot in the radial direction defined by the arm 22 (preferably of the same color) toward the corresponding vision marker 26 of the same color as the shooting marker 24.

While the invention has been described in terms of a particular embodiment, it is apparent that other forms could be adopted by one skilled in the art. For example, the apparatus could differ in appearance and construction from the embodiment shown in the Figures, and appropriate materials could be substituted for those noted. Accordingly, it should be understood that the invention is not limited to the specific embodiment illustrated in the Figures. It should also be understood that the phraseology and terminology employed above are for the purpose of disclosing the illustrated embodiment, and do not necessarily serve as limitations to the scope of the invention. Therefore, the scope of the invention is to be limited only by the following claims.

What is claimed is:

1. A basketball training apparatus for use with a basketball rim placed above a playing surface, the basketball training apparatus comprising:

a base on the playing surface beneath the basketball rim;

a plurality of arms extending in radial directions from the base;

a plurality of shooting markers spaced apart along the length of each of the arms;

at least one member attached to the basketball rim, the at least one member comprising vision markers, each vision marker being radially aligned with a corresponding one of the arms;

wherein a user, when standing on one of the shooting markers of one of the arms and facing the basketball rim, is provided with visual shooting assistance as a result of the arm being radially aligned with one of the vision markers located on a region of the basketball rim that is nearest the user.

2. The basketball training apparatus according to claim 1, wherein the arms and the vision markers are color-coded, so that each of the vision markers and its corresponding one of the arms comprise indicia of the same color.

3. The basketball training apparatus according to claim 1, wherein the shooting markers and the vision markers are color-coded, so that each of the vision markers and the shooting markers on its corresponding one of the arms comprise indicia of the same color.

4. The basketball training apparatus according to claim 1, wherein each of the shooting markers comprises a platform having an upper surface on which foot imprints are defined.

5. The basketball training apparatus according to claim 4, wherein the foot imprints and the vision markers are color-coded, so that each of the vision markers and the foot imprints of the shooting markers on its corresponding one of the arms are the same color.

6. The basketball training apparatus according to claim 1, wherein the arms, the shooting markers and the vision markers are color-coded, so that each of the vision markers, its corresponding one of the arms, and the shooting markers on the corresponding one of the arms comprise indicia of the same color.

7. The basketball training apparatus according to claim 1, further comprising arrow markers along the length of each of the arms, the arrow markers pointing toward the base.

8. The basketball training apparatus according to claim 7, wherein the arrow markers and the vision markers are color-coded, so that each of the vision markers and the arrow markers on its corresponding one of the arms are the same color.

9. The basketball training apparatus according to claim 7, wherein the arms, the arrow markers and the vision markers are color-coded, so that each of the vision markers, its corresponding one of the arms, and the arrow markers on the corresponding one of the arms comprise indicia of the same color.

10. The basketball training apparatus according to claim 1, wherein the arms have approximately equal lengths and terminate at radially-outward distal ends.

11. The basketball training apparatus according to claim 1, wherein the arms are connected to the base and not to each other.

12. The basketball training apparatus according to claim 1, wherein the arms comprise a plurality of individual straps that are radially aligned and between which the shooting markers are located.

13. The basketball training apparatus according to claim 1, wherein the at least one member attached to the basketball rim comprises a tube having a C-shaped cross-section, the member is releasably attached to the basketball rim, and the vision markers are color-coded regions on the tube.

14. The basketball training apparatus according to claim 1, wherein each of the vision markers comprises a tube having a C-shaped cross-section, and the vision markers are individually releasably attached to the basketball rim.

15. A basketball training apparatus for use with a basketball rim placed above a playing surface, the basketball training apparatus comprising:

a base on the playing surface beneath the basketball rim;

a plurality of arms extending in different radial directions from the base;

a plurality of shooting markers spaced apart along the length of each of the arms;

a plurality of vision markers releasably attached to the basketball rim, each of the vision markers having a C-shaped cross-section so as to be releasably attached to the basketball rim, each of the vision markers being radially aligned with a corresponding one of the arms;

wherein each of the vision markers is color-coded with at least one of the arm with which the vision marker is aligned and the shooting markers on the arm with which the vision marker is aligned; and wherein a user, when standing on one of the shooting markers of one of the arms and facing the basketball rim, is provided with visual shooting assistance as a result of the arm being radially aligned with one of the vision markers located on a region of the basketball rim that is nearest the user and the vision marker is the same color as at least one of the shooting marker on which the user is standing and the arm on which the shooting marker is located.

16. The basketball training apparatus according to claim 15, wherein the vision markers are color-coded with the arms and the shooting markers, so that each of the vision markers, its corresponding one of the arms, and the shooting markers on the corresponding one of the arms comprise indicia of the same color.

17. The basketball training apparatus according to claim 15, wherein each of the shooting markers comprises a platform having an upper surface on which foot imprints are defined, and the foot imprints comprise indicia of the same color as the vision markers with which their corresponding arms are radially aligned.

18. The basketball training apparatus according to claim 15, further comprising arrow markers placed along the length of each of the arms, the arrow markers pointing toward the base, and the arrow markers being the same color as the vision markers with which their corresponding arms are radially aligned.

19. The basketball training apparatus according to claim 15, wherein the arms have approximately equal lengths and terminate at radially-outward distal ends.

20. The basketball training apparatus according to claim 15, wherein the arms comprise a plurality of individual straps that are radially aligned and between which the shooting markers are located.

* * * * *